US005804760A

United States Patent [19]

Flynn

[11] Patent Number: 5,804,760

[45] Date of Patent: Sep. 8, 1998

[54] METHOD FOR MAKING AND STORING CRYOGENIC MONOPROPELLANT

[75] Inventor: Thomas M. Flynn, Louisville, Colo.

[73] Assignee: Cryoco, Inc., Louisville, Colo.

[21] Appl. No.: 880,269

[22] Filed: Jun. 23, 1997

[51] Int. Cl.[6] ..... C06B 21/00; C06B 45/00

[52] U.S. Cl. ..... 149/109.6; 149/1; 60/217

[58] Field of Search ..... 149/1, 109.6; 60/217

[56] References Cited

U.S. PATENT DOCUMENTS

| | | | |
|---|---|---|---|
| 2,939,778 | 6/1960 | McKinley | 52/1 |
| 3,009,316 | 11/1961 | McKinley | 60/35.4 |
| 3,282,750 | 11/1966 | Hemstreet | 149/1 |
| 3,779,009 | 12/1973 | Friedman | 60/217 |
| 4,074,629 | 2/1978 | Colgate | 102/23 |
| 4,854,982 | 8/1989 | Melvin et al. | 149/109.6 |
| 5,705,771 | 1/1998 | Flynn et al. | 149/1 |

FOREIGN PATENT DOCUMENTS 855200 6/1957 United Kingdom .

*Primary Examiner*—Peter A. Nelson
*Attorney, Agent, or Firm*—Stephen A. Gratton

[57] ABSTRACT

A method and assembly for manufacturing and storing a cryogenic monopropellant, such as cryogenic mixtures of liquid methane and liquid oxygen, and the components thereof. A fuel, such as liquid methane, is manufactured and stored safely and effectively without venting any methane vapors. Liquid methane and liquid oxygen are manufactured such that these components are mixed at thermal equilibrium thereby preventing the formation of vapors in the liquid phase. In this manner, the mixture can be safely stored and used.

27 Claims, 6 Drawing Sheets

MOX Containment Vessel

METHOD FOR MAKING AND STORING CRYOGENIC MONOPROPELLANT

FIELD OF THE INVENTION

This invention relates to methods of making monopropellants or explosives, such as cryogenic mixtures of liquid methane and liquid oxygen, and more particularly, to such methods which are safe and permit the resultant monopropellant or explosive, such as liquid methane and oxygen, to be safely stored and used without substantial loss.

DESCRIPTION OF THE RELATED ART

A monopropellant is a single phase solid or liquid which contains both a fuel and an oxidant, the latter in a sufficient quantity to burn the fuel into gaseous products of combustion. Monopropellants, such as cryogenic mixtures of liquid methane and liquid oxygen (hereinafter referred to as "MOX"), are conventionally produced in a variety of ways.

U.K. Patent No. 855,200 to McKinley notes that mixtures of liquid oxygen and liquid methane should consist of a single liquid phase without a solid precipitate or a second immiscible liquid phase comprising methane being present therein. To reduce the hazards involved in preparing, handling and storing such liquid mixtures, McKinley maintains the composition of the vapor above the solution inflammable by ensuring that the concentration of methane in the mixtures of oxygen and methane in the vapor phase renders the vapor inflammable or by adding a gaseous diluent to the vapor phase. In another embodiment, McKinley renders the vapor phase nonflammable by providing a floating film or follower for the surface of the solution thereby preventing or greatly reducing the vapor phase.

U.S. Pat. No. 3,009,316 to McKinley discloses a process for the preparation of a monopropellant, for example liquid methane and liquid oxygen, wherein a composition of methane-oxygen vapor phase is maintained above a solution of liquid methane in liquid oxygen to lessen the hazard of preparing and using the monopropellant. The concentration of methane in the vapor phase varies between 5.4 mole % and 59.2 mole % at atmospheric pressure so as to render the vapor mixture inflammable. However, such method is impractical due to the inherent problem of sustaining burning of an inflammable vapor phase.

U.S. Pat. No. 4,074,629 to Colgate discloses a method of blasting rock wherein liquid oxygen and a cryogenic fuel, such as liquid methane, liquid ethane or liquid propane, are separately piped safely from remote sources through cryogenic lines into a cryogenic container which is placed in a hole in the rock. The filling of this container occurs just prior to ignition or detonation of the blasting agent so as to minimize boil off of the liquid oxygen. Any oxygen that boils off during filling and holding is vented through a vent pipe leading from the container. The liquid oxygen and cryogenic fluid mix during filling. An initiator in the form of sticks of dynamite or a mass of blasting gel is placed adjacent the container and connected to a detonator control. The initiator is set off to detonate the liquid oxygen and cryogenic fuel in the container which produces shock sufficient to blast the rock.

U.S. Pat. No. 3,799,009 to Friedman discloses a gas pressurization device wherein a gaseous mixture of an inert gas, fuel and oxidizer which is normally non-reactive becomes reactive upon exposure to a catalyst to provide gas at high temperature.

All of these processes require the vapor phase which is present above a mixture of liquid methane and liquid oxygen to be vented or maintained in an inert or inflammable state and/or that the temperature and pressure be controlled to prevent the formation of a solid phase in the MOX so as to prevent premature combustion. However, these prior methods have not proved to be totally satisfactory in rendering MOX safe during storage and handling thereof. Thus, a need exists for a method of preparing and storing MOX which effectively renders MOX safe and free from the hazards of premature combustion.

OBJECTS OF THE INVENTION

Accordingly, it is an object of the present invention to provide a process for the preparation and storage of monopropellants, such as MOX, which is substantially free from the hazards of premature combustion.

It is another object of the present invention to provide a process for the preparation and storage of monopropellants, such as MOX, in which substantially none of the monopropellant is vaporized and therefor lost due to venting.

It is a further object of the present invention to provide a process for the preparation and storage of monopropellants, such as MOX, wherein the formation of solids such as by condensation is substantially eliminated.

Other objects, advantages and capabilities of the present invention will become more apparent as the description proceeds.

SUMMARY OF THE INVENTION

To achieve the foregoing and other objects, and in accordance with the purposes of the present invention, as embodied and broadly described therein, one characterization of the present invention comprises a method of manufacturing a monopropellant. In accordance with this method, a fuel is provided as a single phase, subcooled liquid and an oxidant is provided as a single phase, subcooled liquid. The fuel and the oxidant are mixed to form a single phase, liquid monopropellant. The temperature of the fuel and the temperature of the oxidant are substantially equal so that the formation of vapor within the monopropellant is inhibited.

In accordance with another embodiment of the present invention, an assembly for manufacturing a monopropellant is provided which comprises a first vessel containing a mixture of a first fuel and a first oxidant and a second vessel containing a second fuel. The first vessel is positioned within and is in thermal equilibrium with the second vessel.

DETAILED DESCRIPTION OF THE PREFERRED EMBODIMENT

As utilized throughout this description, the term "monopropellant" and "explosive" refer to a single phase solid or liquid which contains both a fuel and an oxidant under cryogenic conditions, the latter being present in a sufficient quantity to burn the fuel into gaseous products of combustion. The term "MOX" refers to cryogenic mixtures of liquid methane and liquid oxygen. Applicant has discovered that during the preparation and storage of a monopropellant, such as MOX, the heat transfer which is always occurring from the surroundings to the cold liquid, i.e. the "heat leak", will cause the formation of vapor bubbles up to the point of the liquid boiling. In accordance with the processes of the present invention, the monopropellant is produced and stored such that vapors are not formed in the liquid phase. In this manner, the monopropellant is rendered safe during the manufacture and storage thereof.

MOX comprises liquid methane and liquid oxygen. Liquid oxygen is readily available throughout the world as either an adjunct to health treatment or as a supply of welding gas. In addition, numerous commercial units are conventionally utilized to manufacture liquid oxygen directly from the atmosphere, such as the units marketed under the generic name "air separation plants" by Praxair, Inc., 39 Old Ridgebury Road, Danbury, Conn. 06810. Although gaseous methane is readily available throughout the world, liquid methane is not.

Figure 1:
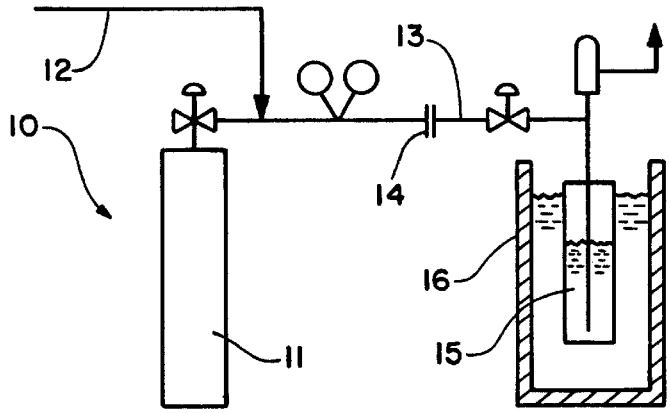
FIG. 1 is a schematic of a process for producing liquid methane from gaseous methane.

Referring to FIG. 1, a process for producing liquid methane from gaseous methane is illustrated generally as system 10. In accordance with this process, methane gas from a high pressure gas cylinder 11 or a conventional low pressure (e.g., 1 psig) gas main 12 is fed via line 13 having a suitable disconnect 14 to a container 15. Container 15 is positioned within an outer container 16 of larger dimensions which is partially filed with liquid oxygen or "LOX" and is exposed at its upper end to the atmosphere. The LOX in container 15 is heated to its boiling point by any suitable means, such as a heat leak from the surroundings. Outer container 16 is insulated by a relatively inexpensive insulative material, for example evacuated perlite. Since the normal boiling point of LOX is 90 K, the gaseous methane present in container 15 will condense as a liquid at its normal condensation point of 112 K. This method is self regulating because LOX will cyropump the methane gas into the condenser only as fast as it can be condensed. Container 15 can be released by means of disconnect 14 and moved to a point of use. This process is a batch process. Since the boiling point of liquid oxygen, i.e. 90 K, is above the freezing point of liquid methane, i.e. 89 K, a solid phase of liquid methane cannot be formed by this manufacturing process. And since the boiling point of LOX is well below the normal boiling point of liquid methane, i.e. 112 K, the liquid methane produced by this method will be a single phase, subcooled liquid. Although other heat exchange mediums for making single phase liquid methane can be utilized with the process of the present invention, LOX is preferred since LOX will exactly condense liquid methane without freezing or boiling occurring. Regulation of the normal boiling point of liquid oxygen is not necessary since it is thermodynamically correct for this purpose.

Figure 2:
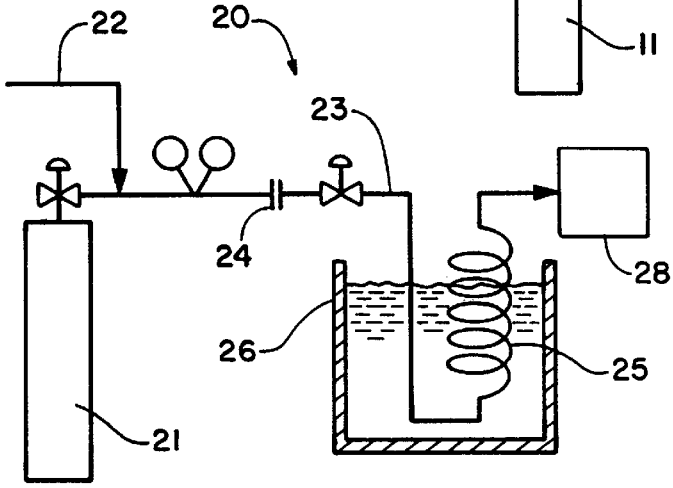
FIG. 2 is a schematic of another embodiment of a process for producing liquid methane from gaseous methane in accordance with the present invention.

Turning to FIG. 2, a continuous process for producing liquid methane from gaseous methane is illustrated generally as system 20. In accordance with this process, methane gas from a high pressure gas cylinder 21 or a conventional low pressure gas main 22 is fed via line 23 having a suitable disconnect 24 to a heat exchanger 25 which is positioned within a container 26. Container 26 is insulated by a relatively inexpensive material, for example perlite, and is partially filed with liquid oxygen or "LOX". Container 26 is open at the upper end thereof so as to expose LOX contained therein to the atmosphere. The LOX in container 26 is heated to its boiling point by any suitable means, such as a heat leak form the surroundings. The heat exchanger 25 is preferably a coiled metal tube constructed of, for example, conventional copper refrigerator tubing. Since the normal boiling point of LOX is 90 K, the gaseous methane present in heat exchanger 25 will condense as a liquid at its normal condensation point of 112 K. This method is self regulating because LOX will cyropump the methane gas into the condenser only as fast as it can be condensed. This process is operated continuously as the liquid which is produced by this process will be transferred by generated pressure to liquid methane storage 28. Since the boiling point of liquid oxygen, i.e. 90 K, is above the freezing point of liquid methane, i.e. 89 K, a solid phase of liquid methane cannot be formed utilizing this manufacturing process. And since the boiling point of LOX is well below the normal boiling point of liquid methane, i.e. 112 K, the liquid methane produced by this method will be a single phase, subcooled liquid. LOX is the preferred heat transfer agent for the continuous method of producing single phase liquid methane of FIG. 2 for the reasons set forth above with respect to FIG. 1.

Figure 3:
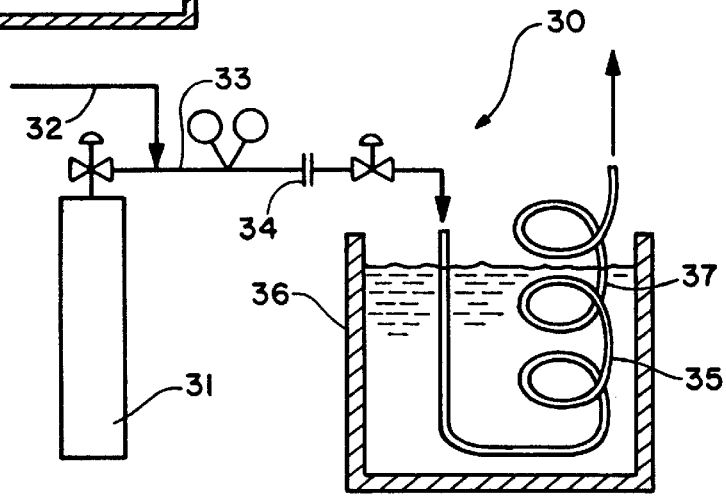
FIG. 3 is a schematic of a still another embodiment of a process for producing liquid methane from gaseous methane in accordance with the present invention.

A process for producing liquid methane which can be operated either continuous or on a batch basis is illustrated generally as system 30 in FIG. 3 and utilizes liquid nitrogen to condense gaseous methane. Methane gas from a high pressure gas cylinder 31 or a conventional low pressure gas main 32 is fed via line 33 having a suitable disconnect 34 to a heat exchanger 35 which is positioned within a conventional cryogenic storage container 36, such as commercially available from Taylor-Wharton International, 4075 Hamilton Blvd., Theodore, Ala. 36590 under the generic name "dewar". Container 36 is partially filed with liquid nitrogen which is obtained from any conventional source as will be evident to a skilled artisan and is boiling at the conditions present in the container, e.g. 1 atmosphere and 77 K. Container 36 is open at the upper end thereof so as to expose the liquid nitrogen contained therein to the atmosphere. The heat exchanger 35 is preferably a coiled metal tube constructed of, for example, conventional copper refrigerator tubing, which is surrounded with a layer 37 of insulative material, such as fibrous glass, cork or polymeric material, which is of a sufficient thickness to ensure that the temperature of the internal wall of heat exchanger is maintained above 90 K. The condensation of gaseous methane to the liquid state in heat exchanger 35 is sufficiently exothermic to warm the inner surface of the heat exchanger tube to 90 K given insulative layer 37. Since the temperature of the inner surface of the heat exchanger tube is maintained by insulative layer 37 at a temperature, i.e. 90 K, above the freezing point of liquid methane, i.e. 89 K, a solid phase of liquid methane cannot be formed utilized this manufacturing process. And since the temperature of the inner surface of the heat exchanger tube, i.e. about 89 K, is well below the normal boiling point of liquid methane, i.e. 112 K, the liquid methane produced by this method will be a single phase, subcooled liquid. In accordance with the method of FIG. 3, heat exchanger 35 is intentionally insulated to retard heat transfer in order to prevent the freezing of liquid methane. Such insulation of a heat exchanger to slow down heat transfer is contrary to the conventional practice of making a heat exchanger as efficient as possible for transferring heat.

Figure 4:
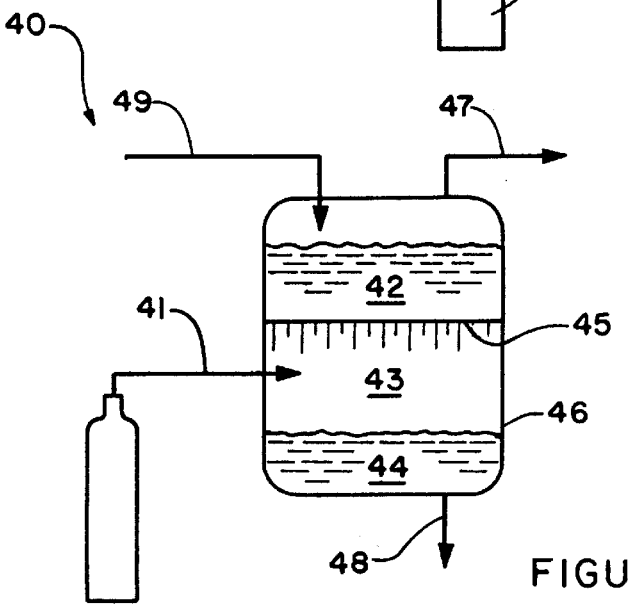
FIG. 4 is a schematic of further embodiment of a process for producing liquid methane from gaseous methane in accordance with the present invention.

Another embodiment of the present invention for producing liquid methane which utilizes liquid nitrogen to condense gaseous methane and which can be operated either continuous or on a batch basis is illustrated generally as system 40 in FIG. 4. In this embodiment, frozen methane is utilized in lieu of the insulating layer 37 of FIG. 3 as a thermal insulator between liquid nitrogen and the metal conduit, tube or line carrying gaseous methane. Gaseous methane is supplied from a high pressure gas cylinder(s) or a low pressure gas main as described above via line 41 to container 46 at a location intermediate the length thereof. Container 46 is supplied with commercially available liquid nitrogen via line 49 which boils into a vapor which is vented from container 46 via line 47 at about atmospheric pressure which maintains the temperature of the liquid nitrogen at 77 K. The contact between the liquid nitrogen 42 and gaseous methane 43 present in container 46 causes the gaseous methane to freeze so as to form a layer 45 of methane ice until a temperature equal to the boiling/condensing point of methane is reached. At this point methane will condense as a liquid and segregate by gravity to the bottom of container 46 forming a layer 44 therein. Liquid methane is then withdrawn either continuously or as a batch via line 48 for subsequent use. Because the ice layer of solid methane effectively insulates the condensing liquid methane from the liquid nitrogen at 77 K, only a single phase subcooled liquid methane product is formed by this process. Presently, heat exchangers are designed such that a solid never forms on the heat exchanger surface since it is well known that such solid formation retards heat transfer and decreases the efficiency of the heat exchanger. The process illustrated in FIG. 4 is deliberately designed for the contrary condition as a means of self regulating the formation of liquid methane from a refrigerant, in this case, liquid nitrogen which is colder than the freezing point of the liquid methane. Solid methane will form to such a depth that its surface temperature is substantial equal to the condensing temperature of subcooled liquid methane.

Figure 5:
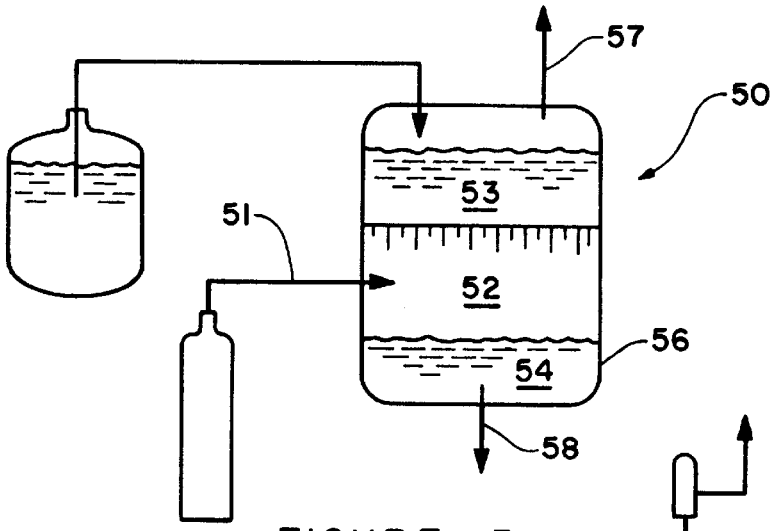
FIG. 5 is a schematic of a still further embodiment of a process for producing liquid methane from gaseous methane in accordance with the present invention.

Another embodiment of the present invention for producing liquid methane which utilizes LOX to condense gaseous methane and which can be operated either continuous or on a batch basis is illustrated generally as system 50 in FIG. 5. In this embodiment, there is no insulating layer between LOX and the metal conduit, tube or line carrying gaseous methane since the normal boiling point of LOX, 90 K, is above the freezing point of methane, 89 K. Gaseous methane is supplied from a high pressure gas cylinder(s) or a low pressure gas main as described above via line 51 to container 56 at a location intermediate the length thereof. Container 56 is supplied with commercially available LOX which boils into a vapor which is vented from container 56 via line 57 at about atmospheric pressure which maintains the temperature of LOX at 90 K or above. The contact between LOX 53 and gaseous methane 52 present in container 56 causes the gaseous methane to condense as a subcooled liquid. Methane will condense as a subcooled liquid and segregate by gravity to the bottom of container 56 forming a layer 54 therein. Liquid methane is then withdrawn either continuously or as a batch via line 58 for subsequent use. Since the condensing liquid methane is substantially at the temperature of the liquid oxygen, i.e., 90 K, only a single phase subcooled liquid methane product is formed by this process. LOX is the preferred heat transfer sink of the embodiment of FIG. 5 since the normal boiling point of LOX is exactly that desired to condense liquid methane as a single phase subcooled liquid without vapor formation. Regulation of the LOX temperature is not required.

Figure 6:
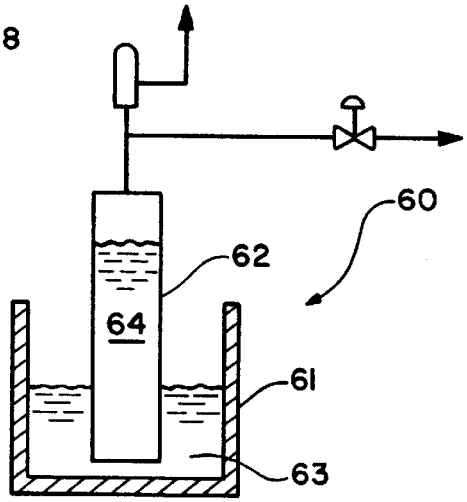
FIG. 6 is a schematic of a process for storing liquid methane.
Figure 7:
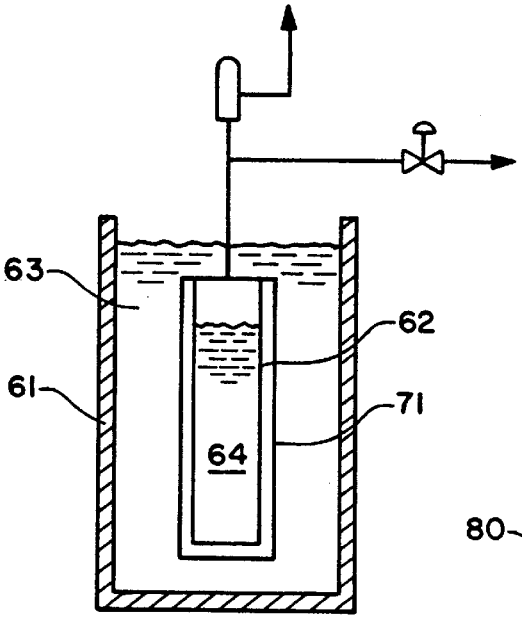
FIG. 7 is a schematic of another embodiment of a process for storing liquid methane.

Once liquid methane has been produced as a single phase in accordance with the process described above, the liquid methane must be capable of being stored safely and effectively without venting any methane vapors. As illustrated in system 60 of FIG. 6, liquid methane 64 in a metal container 62 is positioned within an outer container 61 of larger dimensions which is partially filed with liquid nitrogen 63 such that container 61 is partially immersed within liquid nitrogen 63 boiling at 1 atmosphere and 77 K. Heat which is transferred from the surroundings into the liquid methane in container 62 is transferred in two manners. First, some of this heat is transferred into the liquid methane to maintain the temperature thereof above the freezing point of liquid methane, i.e. 89 K. The balance of the heat transferred is dissipated into liquid nitrogen 63. The degree of immersion is controlled by raising or lowering container 62 or by adjusting the amount of liquid nitrogen 63 in outer container 61 as will be evident to a skilled artisan. Alternatively, container 62 may be totally or partially surrounded by liquid nitrogen layer 63 in outer container 61 as illustrated in FIG. 7. In this embodiment, the container 62 can be provided with an outer layer of insulation which is designed by varying the quality and/or amount thereof to limit heat transfer from the liquid methane to the surrounding liquid nitrogen so as to subcool the liquid methane but not to freeze it. The outer layer of insulation can be omitted in this embodiment and a thin film of methane ice (not illustrated) allowed to form on the inner surface of container 62. The thickness of the thin film of methane ice automatically changes in response to the heat being transferred until an equilibrium is maintained. In this embodiment, the heat leaking to container 62 will be transferred to the thin film of methane ice.

Figure 8:
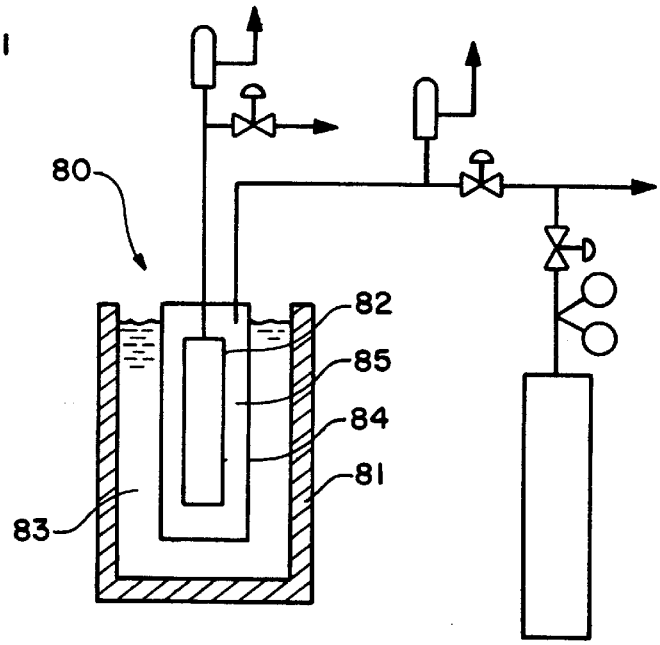
FIG. 8 is a schematic of a still another embodiment of a process for storing liquid methane.

An alternative method of safely and effectively storing liquid methane without venting any methane vapors is illustrated generally as system 80 in FIG. 8. Liquid methane in a metal container 82 is positioned within an outer container 81 of larger dimensions which is partially or completely filled with liquid nitrogen 83 such that container 82 is partially or completely immersed within liquid nitrogen 83 boiling at 1 atmosphere and 77 K. In this embodiment, container 82 is positioned within a closed container 84 which is filled with any non-condensible gas which has a boiling point below that of nitrogen, such as helium, argon or Krypton. The pressure of the non-condensible gas is regulated to limit heat transfer from the liquid methane to the surrounding liquid nitrogen so as to subcool the liquid methane but not freeze it. In accordance with the process of the present invention, container 84 is designed to retard heat transfer between containers 81 and 82 by means of a variable pressure exchange gas so that liquid nitrogen 83 acts as a heat sink to subcool but not freeze methane. Such design is contrary to conventional practice of making heat transfer from vessel 87 to liquid nitrogen 83 as efficient as possible.

Figure 9:
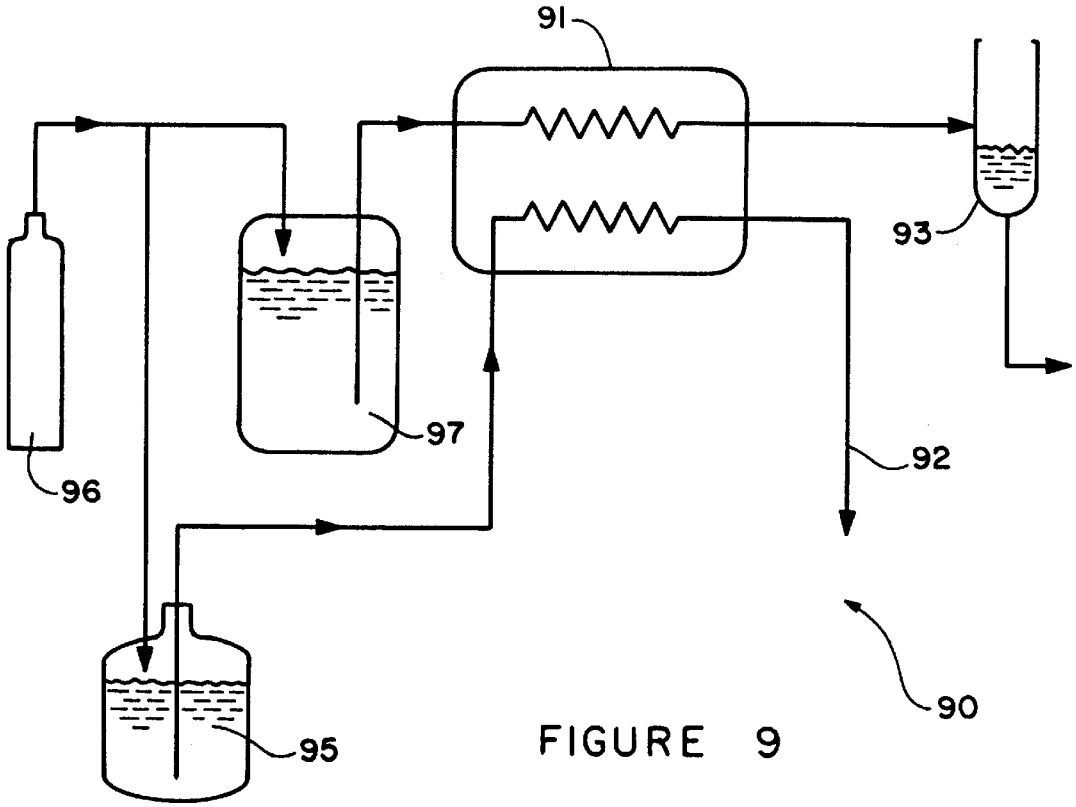
FIG. 9 is a schematic of a further embodiment of a process for making subcooled liquid methane safely and effectively.

Another alternative method of safely and effectively storing liquid methane without venting is illustrated generally as system 90 in FIG. 9 and incorporates additional safety features. Liquid nitrogen is stored in bulk in a container or dewar vessel 95, such as commercially available from Taylor-Wharton, Intl., 4075 Hamilton Blvd., Theodore, Ala. 36590 under the generic name "dewar vessel". Liquid is caused to flow through heat exchanger 91 by means of a pump (not illustrated) or by introducing an inert gas, for example nitrogen, which is introduced from a gas cylinder 96 under pressure into vessel 95 via a suitable line. This inert gas may also be used to transfer liquid methane which is manufactured in accordance with the process of the present invention from storage vessel 97 to heat exchanger 91. Heat exchanger 91 is any suitable commercially available heat exchanger, such as a tube and shell, as will be evident to a skilled artisan. Any of the methods described above may be employed to ensure that liquid nitrogen does not freeze the liquid methane in heat exchanger 91. Nitrogen leaves the heat exchanger 91 as a gas and may be mixed with oxygen gas so as to be safely vented especially in closed environments, for example underground mines. The subcooled liquid methane is transported to a separator 93 wherein vapor is separated from liquid and is flare or catalytically burned, such as by a catalytic combustion device conventionally used in space heating. The liquid methane is transported for use in formulating MOX.

Figure 10:
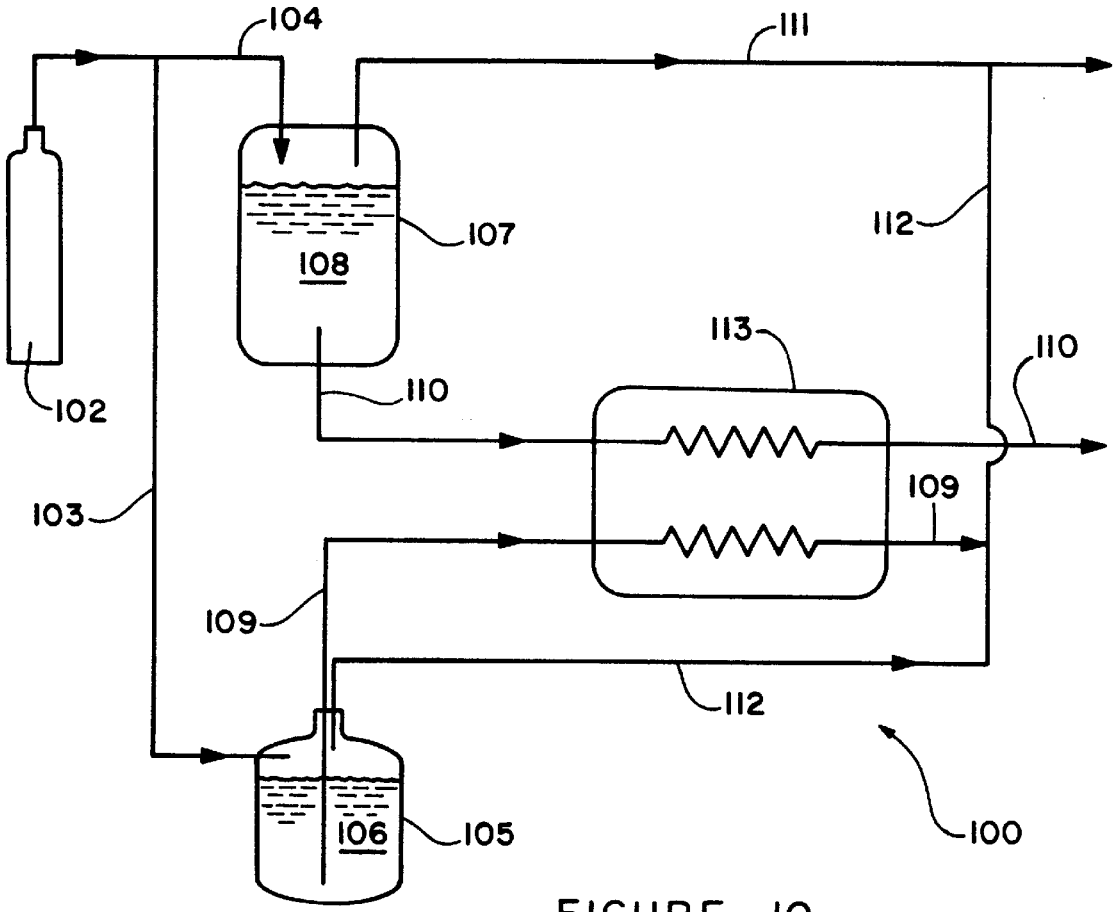
FIG. 10 is a method of safely and effectively subcooling and storing liquid oxygen.

A method of safely and effectively subcooling and storing LOX without venting any vapors or freezing LOX is illustrated in system 100 of FIG. 10. In accordance with this method, LOX which is commercially available at its normal boiling point temperature, i.e. 90 K, is pressured transferred from container or dewer vessel 108 to heat exchanger 113 by means of a high pressure gas, i.e. nitrogen, which is supplied from cylinder 102 to container or vessel 108 via line 104. This same gas may be transferred via line 103 into the top of container 105 containing liquid nitrogen 106 so as to transfer the liquid nitrogen via line 109 to heat exchanger 113. LOX subcooled to 77 K is transferred for MOX manufacture via line 110 while gaseous nitrogen produced in heat exchanger 113 is mixed with gaseous oxygen which is vented from container or vessel 108 via line 111 so as to be safely vented especially in closed environments, for example underground mines. The subcooled temperature for LOX, i.e. 77 K, is intermediate between the normal boiling point of LOX (90 K) and the freezing point of $O_2$ (63 K). This subcooled LOX will neither vent as a vapor nor freeze as a solid and therefor can be safely handling during manufacture of MOX.

Figure 11:
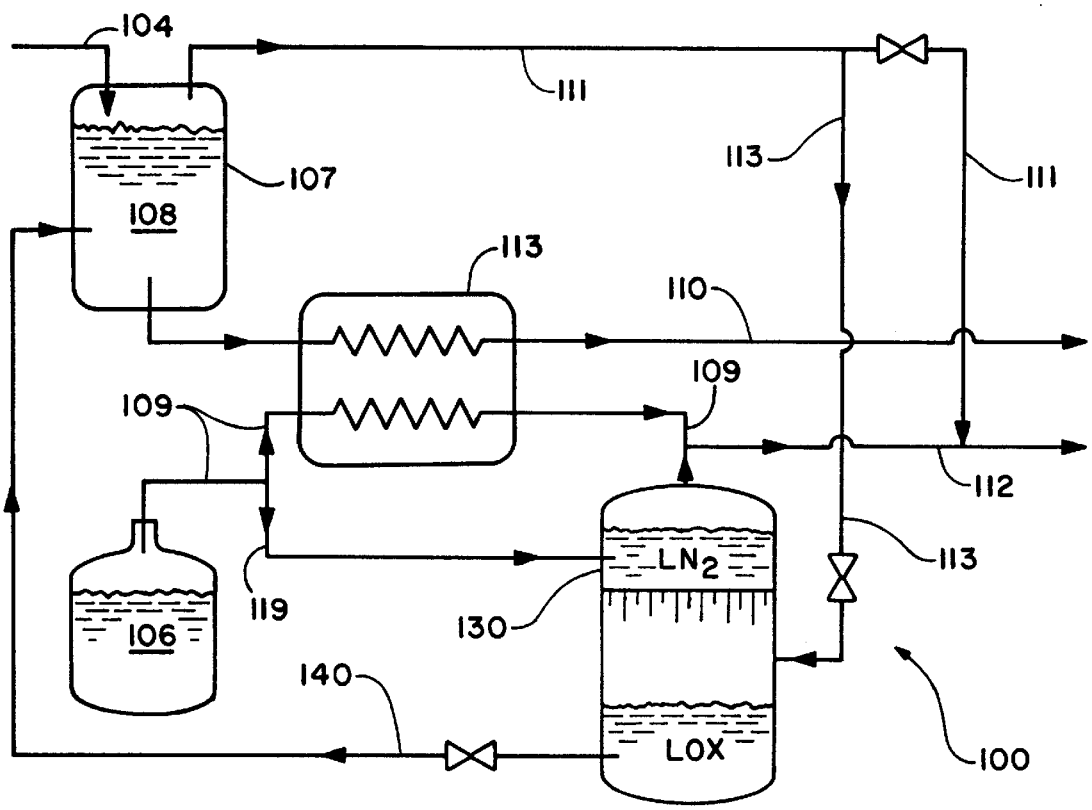
FIG. 11 is a schematic of a process of safely storing and handling liquid methane/oxygen prepared in accordance with the present invention.

As illustrated in FIG. 11, a portion of the gaseous oxygen which is vented from the LOX container or vessel 108 via line 111 is transferred via line 113 to vessel 130 intermediate the length thereof. Liquid nitrogen is transferred from storage container 106 via lines 109 and 119 into the top of vessel 130 where the gaseous oxygen is completely condensed by contact with the liquid nitrogen. This LOX is transferred to the LOX container or vessel 108 via line 140 for further use. In this manner, neither gaseous nitrogen nor gaseous oxygen is vented to the atmosphere and thus the safety hazards associated therewith are eliminated.

Figure 12:
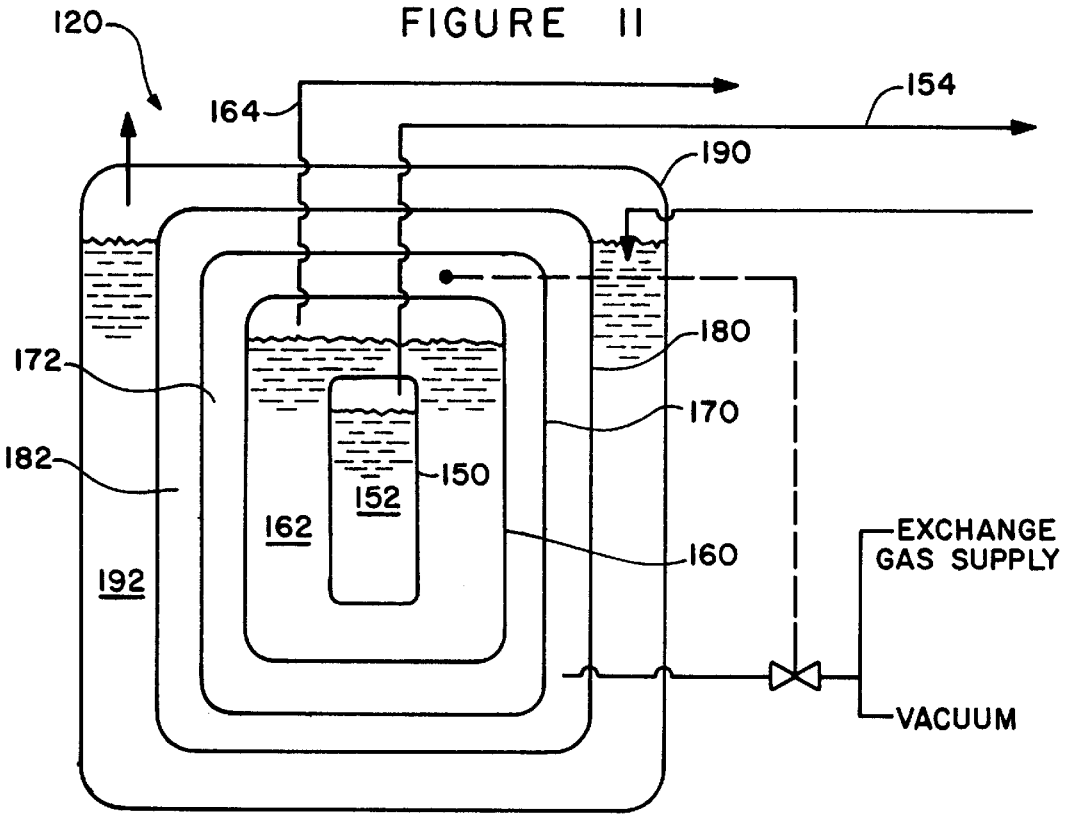
FIG. 12 is a schematic of a method and assembly for the manufacture and storage of a monopropellant, such as a cryogenic mixture of liquid methane and liquid oxygen.

In accordance with the present invention, MOX can be safely and efficiently manufactured from the liquid methane and liquid oxygen (LOX) prepared as described above. In accordance with one embodiment of the method for the manufacture of MOX as illustrated in FIG. 12, five separate vessels or containers 150, 160, 170, 180 and 190 are concentrically arrange as illustrated to form an assembly for manufacturing and storing MOX. LOX and liquid methane are mixed in container 150 to form MOX 152 which is stored in this container at about 90 K and 1 atmosphere pressure. Container 160 is filled with liquid methane 162 at about 90 K, container 170 with LOX 172 at about 90 K and 1 atmosphere, container 180 with any non-condensible gas 182 which has a boiling point below that of nitrogen, such as helium, argon or Krypton, and container 190 with liquid nitrogen 192 at about 77 K and 1 atmosphere. MOX is stored in container 150 without venting or loss since any heat transfer from container 150 is intercepted by container 160 which contains liquid methane at its normal boiling point of 90 K. Thus, containers 150 and 160 are in thermal equilibrium with each other at 90 K. Similarly, any heat transfer from container 160 is intercepted by container 170 which contains LOX at 90 K and therefore is in thermal equilibrium with the liquid methane stored at 90 K in container 160. The liquid nitrogen in container 190 serves as a heat shield for the entire system by intercepting heat from the environment surrounding the entire assembly. The heat transfer from container 190 to container 170 is regulated by the non-condensible gas 182 in container 180 which is essential to prevent the liquid nitrogen of container 190 from chilling the LOX in container 160 which in turn would freeze the liquid methane of container 160 and cause the MOX in container 150 to partially freeze. A small amount of vapor which is formed during storage in container 160 or 190 is vented via lines 164 and 194, respectively.

Because the ambient temperature is always warmer than any cryogenic fluid, heat is always being transferred from the surroundings to the cryogenic fluid. As a consequence, the cryogen must either vaporize and vent (boil) or build up pressure. Either condition can be hazardous in a closed environment, such as a laboratory building or a mining operation. The embodiment illustrated in FIG. 12 prevents vaporization of MOX or liquid oxygen by shunting all heat leak to a guard fluid, such as liquid nitrogen in container 190. For example, it may be desirable to hold MOX at 90.6 K and 1 atm pressure in a subcooled condition without the formation of vapor bubbles and thus without venting or loss in container 150. In this instance and as illustrated in FIG. 12, container 150 is surrounded by liquid methane at 90.1 K and 1 atm pressure, in container 160. Any heat leaking to container 150, through its supports or fill lines, for instance, is transferred automatically from MOX in container 150 to the liquid methane in container 160 by thermodynamic necessity, since container 150 is at a higher temperature than container 160. In the conventional practice, this would cause the liquid methane in container 160 to vaporize and vent. However, in the system 120 of FIG. 12, the liquid methane in container 160 is held in subcooled condition without the formation of vapor bubbles and thus without a vent or loss of liquid methane because container 160 is in turn thermally shielded by liquid oxygen present in container 170 at 90 K and 1 atm pressure. Any heat leaking to the liquid methane of container 160 is automatically transferred to the liquid oxygen in container 170 by thermodynamic necessity since the temperature of container 160 is higher than that of container 170. All of the heat leak to the MOX in container 150 has now passed via container 160 to container 170. Finally the heat reaching container 170 is transferred to the liquid oxygen in container 170 by a unique means. If vessel 190 filled with liquid nitrogen at its normal boiling point of 77 K were in direct contact with liquid oxygen in container 170, the liquid oxygen would eventually be brought to thermal equilibrium at 77 K. Similarly, the liquid methane container 160 would eventually drop by heat transfer to 77 K. Such a low temperature would cause the liquid methane of container 150 to freeze, an undesirable state for good heat transfer. Accordingly, container 170 and container 190 are separated by an exchange gas in the intermediate container 180. Any noncondensible gas such as helium can be used to fill container 180 at a partial pressure less than 1 atm. The pressure of the exchange gas is controlled so as to regulate the amount of heat transfer between containers 170 and 190 such that all of the heat leaking into container 170 by such means as described above is transferred to the liquid nitrogen in container 190 by the thermodynamic necessity that container 170 is at a higher temperature than container 190. Container 170 is maintained at substantially the normal boiling point of liquid oxygen by the customary means of measuring either the temperature (set point desired is 90 K) or the pressure (set point desired is approximately 1 atm). Conventional apparatus used in the instrumentation industry would be employed, such as proportional or logarithmic control devices available from such manufacturers as Omega Engineering Inc., One Omega Drive, Stanford, Conn. 06907-0047. Deviation from either of these set points is sensed by the usual means of thermometry or pressure indication and the pressure of the exchange gas in container 180 is adjusted accordingly, i.e., either to a higher pressure causing more heat transfer to the liquid nitrogen of container 190, or to a lower pressure of the exchange gas which causes less heat transfer to the liquid nitrogen in container 190. All of the heat leaking from the surroundings to containers 150, 160 and 170 is transferred to the liquid nitrogen of container 190. By this arrangement, liquid nitrogen is sacrificed to conserve or prevent the escape of any of the other fluids. Liquid nitrogen so used may be thought of as sacrificial liquid cryogen, or as a thermodynamic guard fluid. All of the heat leak that would ordinarily cause vaporization, boil-off, pressure build up or venting is moved from valuable or hazardous cryogenic fluids, such as methane, oxygen and MOX, to an expendable, less expensive and inert fluid such as liquid nitrogen, in the embodiment illustrated in FIG. 12.

Figure 13:
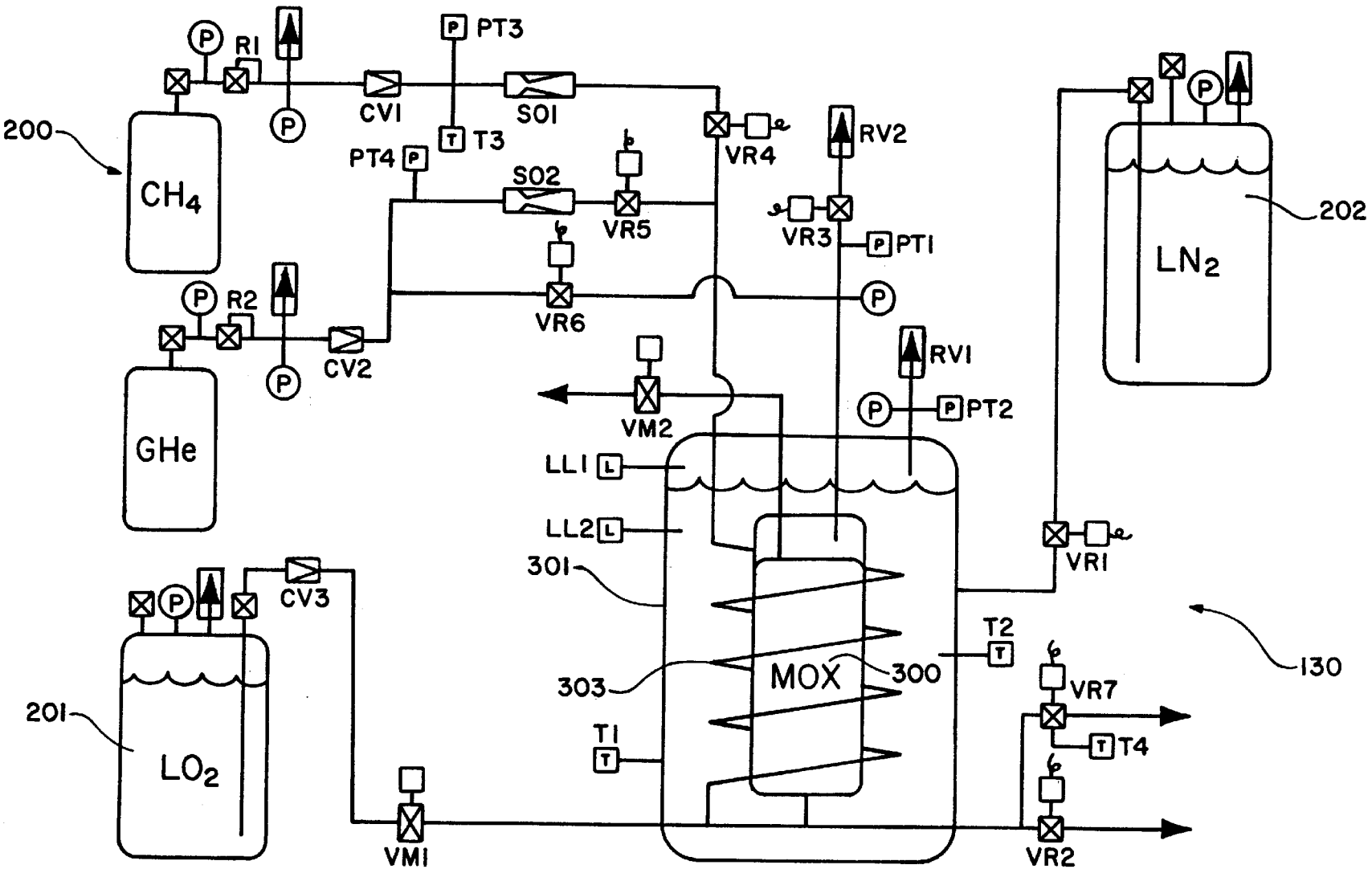
FIG. 13 is a schematic of another embodiment of a method and assembly for the manufacture of a fuel, such as liquid methane, an oxidant, such as liquid oxygen, and monopropellant, such as a cryogenic mixture of liquid methane and liquid oxygen in accordance with the present invention.

FIG. 13 illustrates another embodiment of manufacturing liquid methane, LOX, and MOX in accordance with the present invention. The system 130 includes a MOX containment vessel 300 and an outer vessel 301. A MOX containment vessel 300 has a capacity of about 4 liters and is designed for a working pressure of up to 500 psia to allow pressurized transfer of MOX to the end use. The MOX containment vessel 300 is jacketed by liquid nitrogen ($LN_2$) contained in outer vessel 301 which is maintained at, for example, about 75 psia, by a commercially available pressure relief valve. At this pressure, the $LN_2$ has a saturation temperature of −290° F. (170 R, 94.4 K), which is a few degrees above the freezing point of methane (90.6 K). This liquid nitrogen jacket allows long-term storage of the MOX product without shifts in mixture ratio due to boil-off. A coil 303 of stainless steel tubing surrounds the MOX containment vessel 300 and is immersed in the $LN_2$ bath of outer vessel 301. The coil 303 is the methane condenser.

Figure 14:
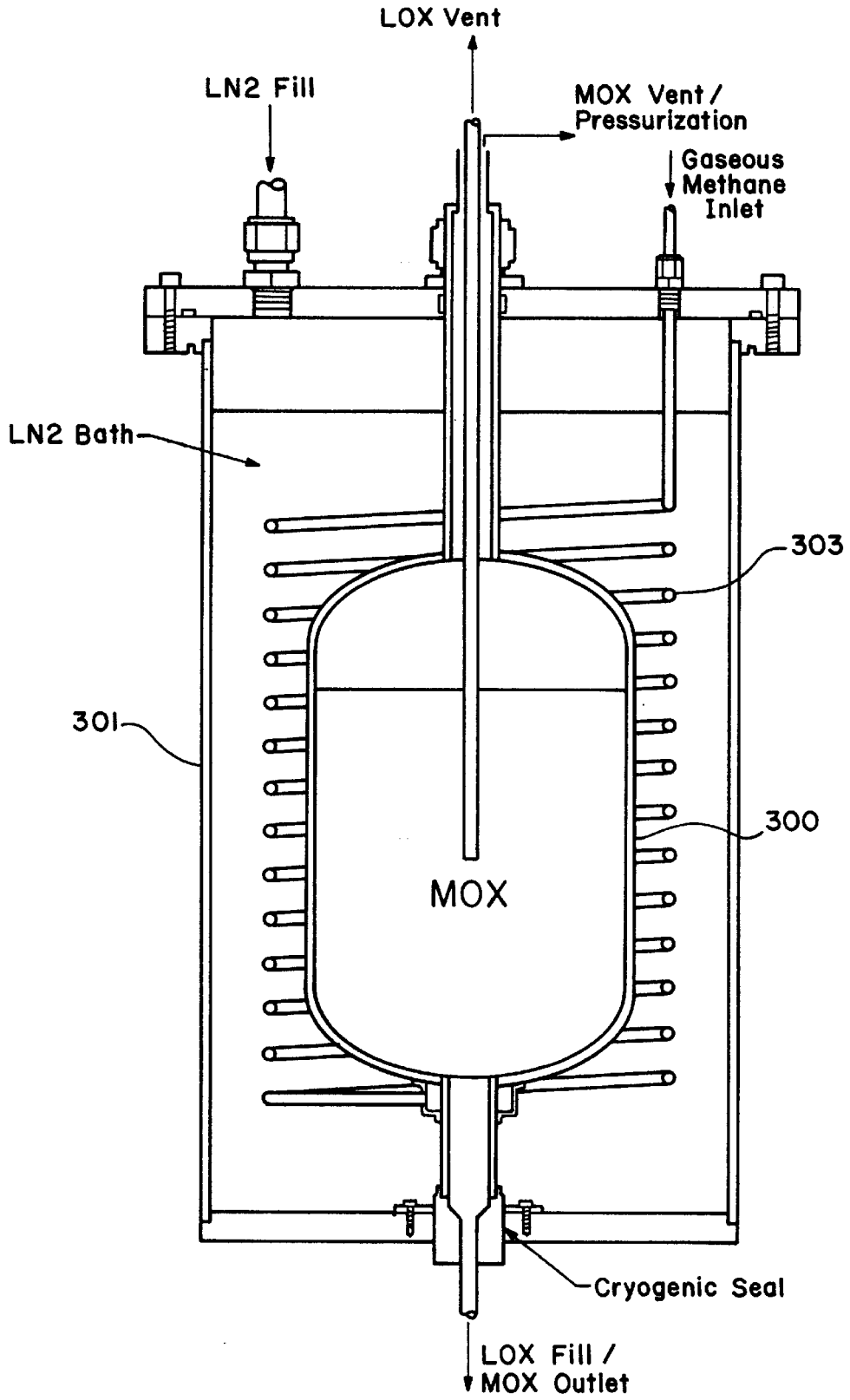
FIG. 14 shows the design of the liquid methane/oxygen containment vessel in accordance with the present invention.

FIG. 14 illustrates the design of the MOX containment vessel 300. The MOX containment vessel 300 is constructed of 6-inch schedule 10 stainless steel pipe, with elliptical tank heads and is designed to operate at up to 500 psia working pressure, with a factor of safety on yield of approximately 2.0. All connections to the MOX containment vessel 300 within the outer vessel 301 are welded or brazed in order to eliminate leaks of MOX into the $LN_2$ jacket. The volume of the MOX containment vessel 300 is, for example, about 336 cubic inches (1.45 gallons) and is designed to contain 250 cubic inches (1.08 gallons) of MOX at a nominal mixture ratio of (O/F) of 3.3. This corresponds to 7.4 lbm of MOX, which is enough to operate a 100 lbf monopropellant rocket engine for approximately 15 to 20 seconds.

The outer vessel 301 can be made from 10-inch schedule 10 stainless steel pipe. The outer vessel 301 operates at, for example, about 60 psig, with a factor of safety of 3.3 on yield and will contain for example, approximately 1000 cubic inches (4.5 gallons) of $LN_2$.

In operation, the system 120 illustrated in FIG. 12 is filled with liquid nitrogen and liquid oxygen as follows:

Prior to the flow of any cryogenic liquids, the tanks and lines are purged of all air and moisture with helium gas. Fill valve VR1 is opened, allowing liquid nitrogen ($LN_2$) to fill the outer vessel 301, forming a bath surrounding the inner MOX containment vessel 300. Pressure relief valve RV1 maintains the $LN_2$ as a saturated liquid at, for example, −290° F. (94.4 K), 75 psia, to prevent freezing and maintain sub-cooled MOX free of vapor bubbles. Manual valve VM1 is then opened, allowing liquid oxygen ($LO_2$) to fill the MOX tank until $LO_2$ vents through VM2. The stand pipe length on the $LO_2$ vent line is calibrated to allow a known volume (mass) of $LO_2$ to fill the MOX containment vessel 300. Liquid oxygen 201 is available from major U.S. corporations such as Praxair, Inc., 175 East Park Drive, Tonawanda, N.Y. 14151-0808. Alternatively liquid oxygen can be produced on-site by such commercial units as the model No. ED-LP-2T available from the Gas Equipment Engineering Corporation, P.O. Box 2-237, Milford, Conn. 06460. Any source of liquid oxygen is also a source of liquid nitrogen, since both are derived from the same raw material, i.e., air. The $LO_2$ valves VM1 and VM2 are then closed, and the $LO_2$ in the MOX containment vessel 300 is maintained at, for example, −290° F. (94.4 K), by the $LN_2$ bath. The $LO_2$ vapor pressure is, for example, about 22 psia at this temperature.

At this point in the operation, MOX production is begun. Remote valve VR4 is opened to allow methane gas ($CH_4$) 200 to flow into the MOX containment vessel 300. Regulator R1 sets the $CH_4$ pressure, monitored by pressure transducer PT3. Sonic orifice SO1 is calibrated so that the mass flow rate of $CH_4$ vs. pressure can be calculated. A sonic orifice gives a fixed gas flow rate, independent of down stream conditions, and is commercially available. The $CH_4$ gas enters the condensing coils 303 in the $LN_2$ bath contained in outer vessel 301, where the $CH_4$ is condensed to a liquid. The $LN_2$ is maintained at a temperature, e.g., −290° F. (94.4 K), which is above the freezing point of $CH_4$ (−296° F., 90.6 K). A commercial liquid level sensor (not shown) signals VR1 to open as the $LN_2$ is depleted, refilling the bath. Cryogenic liquid level sensors are readily available from several manufacturers such as Lake Shore Cryotronics Inc., 64 E. Walnut St., Westerville, Ohio 43081. After a predetermined amount of time, a known quantity of $CH_4$ will have been administered through the sonic orifice (SO1). The mass of $CH_4$ will be slightly less than required to produce the desired mixture ratio with the $LO_2$. At this point, VR4 is closed, stopping further $CH_4$ flow. VR5 is then opened, allowing gaseous helium (He) to flow through the sonic orifice SO2, which controls the He flow rate to the desired value. The He gas displaces any liquid $CH_4$ in the condensing coils 303 into the MOX containment vessel 300 and stirs the MOX by bubbling up through the MOX. The helium is vented through VR3, and the pressure in the MOX containment vessel 300 is maintained at 40 psia by relief valve RV2. After a redetermined amount of time, VR5 is closed, stopping the flow of He. A sample of MOX is taken by opening VR2, allowing a small amount of MOX to flow into an open container. An accurate temperature sensor (not shown) reads the saturation temperature of the MOX as it boils in the open container. The mixture ratio of the MOX is determined from the saturation temperature of the MOX. A calculation determines the amount of $CH_4$ required to bring the MOX to the desired mixture ratio. The steps of allowing methane gas to enter MOX containment vessel 300 and flowing $CH_4$ gas through coils 303 to condense as a liquid followed by a gaseous helium flush as described above may be repeated to bring the MOX up the desired mixture ratio. Once the proper MOX mixture ratio is established, the MOX containment vessel 300 is pressurized to the required pressure by closing the MOX vent valve VR3 and opening the helium valve VR6, which charges the vessel to the desired pressure set by regulator R2. Product valve VR7 is opened to transfer MOX to the point of use. As long as the $LN_2$ bath is maintained, MOX does not evaporate and is maintained at mixture ratio. In order to purge the MOX and safe the system, the MOX product is dumped through VR2 into an open container where the MOX boils off and dissipates. The remaining MOX vapors in the tank are purged out by opening He valve VR5 and/or VR6.

This embodiment as illustrated in FIG. 13 achieves the objective of producing MOX as a single-phase, storage liquid without boiling or vapor bubbles forming and thus without venting or loss of MOX. This is primariy achieved by the pressure controlled liquid nitrogen containing outer vessel 301. The same result could be achieved by replacing outer vessel 301 with vessel 16 of FIG. 1, or with heat exchanger 25 and vessel 26 of FIG. 2, or with heat exchanger 35 and vessel 36 of FIG. 3, or with heat exchanger 45 and vessel 46 of FIG. 4, or with vessels 61 and 62 of FIG. 6, or with the apparatus illustrated in FIG. 7, or the apparatus illustrated in FIG. 8, or with the heat exchanger assembly 91 of FIG. 9, or with the heat exchanger assembly 113 and related equipment of FIG. 10.

Single-phase, non-boiling liquid oxygen could be obtained by the embodiment illustrated in FIG. 13 by replacing the outer vessel 301 and heat exchanger 303 with the heat exchanger 5 and tank 50 of FIG. 5. In this manner, liquid oxygen could be produced without boiling or vapor bubbles forming and thus without venting or loss of LOX.

As thus described, the present invention provides methods and assemblies for producing and storing liquid methane and liquid oxygen at a temperature and pressure which are in thermal equilibrium so that heat is not introduced when these components are mixed to form a monopropellant or explosive, i.e., a cryogenic mixture of liquid methane and liquid oxygen, and therefore vaporization does not occur. In this manner, MOX can be safely stored and used without any substantial loss thereof. Although the description has specifically referred to MOX, it will be evident to the skilled artisan that other cryogenic monopropellants or explosives, for example a cryogenic mixture of liquid oxygen and ethane and/or other light hydrocarbons, can be manufactured and stored in accordance with the methods and assemblies of the present invention.

Thus the invention provides a method for manufacturing a cryogenic monopropellant, such as cryogenic mixtures of liquid methane and liquid oxygen. Although preferred materials have been described, it is to be understood that other materials may also be utilized. Furthermore, although the method of the invention has been described with reference to certain preferred embodiments, as will be apparent to those skilled in the art, certain changes and modifications can be made without departing from the scope of the invention as defined by the following claims.

What is claimed:

1. A method of manufacturing a cryogenic monopropellant comprising:

providing a fuel as a single phase, subcooled liquid, at a first temperature;

providing an oxidant as a single phase, subcooled liquid, at a second temperature substantially equal to or below the first temperature; and mixing the fuel and the oxidant while inhibiting formation of a vapor phase in the fuel, in the oxidant, or in a mixture of the fuel and oxidant to form a single phase, liquid cryogenic monopropellant.

2. The method of claim 1 wherein the fuel comprises liquid methane.

3. The method of claim 2 wherein providing the liquid methane comprises condensing gaseous methane by heat transfer with liquid oxygen.

4. The method of claim 3 wherein the heat transfer comprises providing a heat exchanger in flow communication with the gaseous methane and placed within the liquid oxygen.

5. The method of claim 2 wherein providing the liquid methane comprises condensing gaseous methane by heat transfer with liquid nitrogen via a heat exchanger.

6. The method of claim 4 wherein the heat exchanger comprises an insulative layer.

7. The method of claim 6 wherein the insulative layer comprises a material selected from the group consisting of glass, cork and polymeric materials.

8. The method of claim 6 wherein the insulative layer comprises frozen methane.

9. The method of claim 4 wherein the heat exchanger comprises an insulative layer comprising frozen methane.

10. The method of claim 1 wherein the first temperature and the second temperatures are about 90 K.

11. The method of claim 1 wherein providing the liquid methane comprises condensing gaseous methane by heat transfer with liquid oxygen and then storing the liquid methane in a container submerged in liquid oxygen.

12. The method of claim 1 wherein the oxidant comprises liquid oxygen.

13. The method of claim 1 wherein gaseous oxygen which vaporizes from the liquid oxidant during storage thereof is condensed and added to the liquid oxidant.

14. The method of claim 2 further comprising:

prior to the mixing step preventing the liquid methane from freezing.

15. The method of claim 1 further comprising:

during the mixing step, contacting the monopropellant with a non-condensible gas to aid in the mixing step.

16. The method of claim 15 wherein the non-condensible gas comprises helium.

17. The method of claim 1 wherein the method is performed continuously.

18. The method of claim 1 wherein the method is performed on a batch basis.

19. A method of manufacturing a cryogenic monopropellant comprising:

providing a fuel as a single phase, subcooled liquid;

providing an oxidant as a single phase, subcooled liquid;

mixing the fuel and the oxidant; and maintaining a temperature of the fuel and of the oxidant during the mixing step, below a boiling point of the fuel and below a boiling point of the oxidant to form a single phase, liquid cryogenic monopropellant.

20. The method of claim 19 wherein the fuel comprises methane and the oxidant comprises oxygen.

21. The method of claim 20 wherein providing the fuel comprises condensing gaseous methane by heat transfer with liquid oxygen.

22. A method of manufacturing a cryogenic monopropellant comprising:

providing gaseous methane;

forming single phase, subcooled liquid methane by cooling the gaseous methane to a first temperature below a boiling point of methane;

providing single phase, subcooled liquid oxygen at a second temperature substantially equal to or below the first temperature; and mixing the subcooled liquid methane and the subcooled liquid oxygen at a third temperature substantially equal to or below the second temperature to inhibit formation of vapor phase methane or vapor phase oxygen, and form the monopropellant as a single phase liquid.

23. The method of claim 22 wherein the forming step comprises providing a heat exchanger in flow communication with the gaseous methane and submerged in a vessel containing liquid oxygen.

24. The method of claim 22 wherein the forming step comprises providing a heat exchanger in flow communication with the gaseous methane and submerged in a vessel containing liquid nitrogen.

25. A method of manufacturing a cryogenic monopropellant comprising:

providing gaseous methane;

providing a first container having liquid nitrogen or liquid oxygen therein;

injecting the gaseous methane into a second container submerged in the liquid nitrogen or the liquid oxygen to form liquid methane within the second container;

transferring the liquid methane from the second container to a third container containing subcooled liquid oxygen at a temperature substantially equal to or below a boiling point of the liquid methane; and mixing the liquid methane and the subcooled liquid oxygen in the third container to form the monopropellant as a single phase liquid.

26. The method of claim 25 further comprising prior to the transferring step storing the liquid methane in a fourth container submerged in liquid nitrogen.

27. The method of claim 25 further comprising prior to the transferring step storing the liquid methane in a closed container containing a non-condensible gas, the closed container submerged in a fifth container containing liquid nitrogen.

* * * * *